US009796514B2

(12) United States Patent
Buselli

(10) Patent No.: US 9,796,514 B2
(45) **Date of Patent: *Oct. 24, 2017**

(54) FASTENER WITH ADHESIVE BASE AND TWIST-TIE AND METHOD OF MAKING THE FASTENER AND OF USING THE FASTENER

(71) Applicant: Oscar L. Buselli, Bessemer, MI (US)

(72) Inventor: Oscar L. Buselli, Bessemer, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/001,487

(22) Filed: Jan. 20, 2016

(65) Prior Publication Data

US 2016/0137368 A1 May 19, 2016

Related U.S. Application Data

(60) Division of application No. 14/197,373, filed on Mar. 5, 2014, now Pat. No. 9,260,230, which is a (Continued)

(51) Int. Cl.
*B65D 63/04* (2006.01)
*B65D 63/18* (2006.01)
(Continued)

(52) U.S. Cl.
CPC ..... *B65D 63/04* (2013.01); *B65D 63/18* (2013.01); *B65D 67/00* (2013.01); *D04D 7/10* (2013.01); *B65D 2203/02* (2013.01); *Y10T 24/13* (2015.01); *Y10T 24/14* (2015.01); *Y10T 24/15* (2015.01); *Y10T 24/33* (2015.01); *Y10T 156/1043* (2015.01); *Y10T 156/1052* (2015.01); *Y10T 428/1476* (2015.01); *Y10T 428/24752* (2015.01); *Y10T 428/28* (2015.01)

(58) Field of Classification Search
CPC ..... B65D 67/00; D04D 7/10; Y10T 24/13; Y10T 24/14; Y10T 24/15; Y10T 156/1052
See application file for complete search history.

(56) References Cited

U.S. PATENT DOCUMENTS 4,621,732 A 11/1986 Olson
4,915,996 A 4/1990 Curry
(Continued)

FOREIGN PATENT DOCUMENTS

EP 2261134 12/2010
JP 08071149 3/1996

*Primary Examiner* — Mark A Osele
*Assistant Examiner* — Christopher C Caillouet
(74) *Attorney, Agent, or Firm* — Boyle Fredrickson, S.C.

(57) ABSTRACT

A fastener and a method of making and using the fastener is provided in which the fastener includes a base having a top portion and a bottom portion. The bottom portion includes an adhesive layer portion. An elongated pliable core member is coupled to the base, with the core member having first and second ends, with at least the first end extending beyond an edge of the base. In another embodiment the base is configured to define a plurality of notches, with each notch configured to define an apex proximate the center of the base and extending with the edges toward an edge of the base and with two notches on each side of elongated pliable core member. The plurality of notches defines two sections of the base, with one section configured independently of the other section and with one section on each side of the elongated pliable core member.

14 Claims, 4 Drawing Sheets

Related U.S. Application Data continuation of application No. 12/782,450, filed on May 18, 2010, now Pat. No. 8,691,382.

(60) Provisional application No. 61/268,127, filed on Jun. 8, 2009.

(51) Int. Cl.
*B65D 67/00* (2006.01)
*D04D 7/10* (2006.01)

(56) References Cited

U.S. PATENT DOCUMENTS

| | | | |
|---|---|---|---|
| 5,005,264 | A | 4/1991 | Breen |
| 5,156,641 | A | 10/1992 | White |
| 5,503,102 | A | 4/1996 | McDonnell |
| 7,066,182 | B1 | 6/2006 | Dunshee |
| 2003/0150087 | A1 | 8/2003 | Dieterich |
| 2009/0137961 | A1 | 5/2009 | Bracken |

FASTENER WITH ADHESIVE BASE AND TWIST-TIE AND METHOD OF MAKING THE FASTENER AND OF USING THE FASTENER

CROSS-REFERENCE TO RELATED APPLICATIONS

This patent application is a divisional of U.S. Non-Provisional application Ser. No. 14/197,373, filed Mar. 5, 2014, now U.S. Pat. No. 9,260,230 which is a continuation of U.S. Non-Provisional application Ser. No. 12/782,450, filed on May 18, 2010, now U.S. Pat. No. 8,691,382, which in turn claims priority from U.S. Provisional Patent Application No. 61/268,127 entitled "Twist-Tie With Adhesive Base and Method of Making Same," and which was filed on Jun. 8, 2009, with the entirety of each patent application expressly hereby incorporated herein by reference.

BACKGROUND

This application relates generally to fasteners, and more specifically to fasteners for securing lightweight decorations and objects to a variety of surfaces.

Lightweight decorations are used all over the world for celebrating various occasions including holidays, weddings, birthday parties, etc. These decorations come in all shapes and sizes from frilly garlands to flat banners. The surfaces being decorated consist of various materials, textures, and contours. Examples of these surfaces include: painted or papered drywall, paneling, window and door trim, brick veneer, ceilings, and glass.

Fasteners typically available to attach such decorations include: cellophane tapes, staples hooks, tacks, and even nails. Cellophane tapes are adhesive based. Such tapes are a handy, temporary fastener and do not require penetration into the decorated surface. They are typically used by applying a length of tape that is long enough to go over the top of the decoration and have the ends of the tape adhere to the surface being decorated. This can be a quick, inexpensive way to apply decorations. However, they are applied so that the adhesive tape goes over the top of and comes into contact with the decoration.

When applied over a garland, the adhesive tape compresses the garland at each fastened point, detracting from its appearance. Also, the fringes from the garland usually get in the way when trying to apply the tape to the wall, causing poor adhesion. The tape also damages decorations such as garlands when removing. Cellophane tapes, when used, typically tape over a higher profile decoration, such as a light on a light-string, with the angle of the tape from the top of the light to the decorated surface being such that it is similar to the angle at which one would use to remove the tape when peeling tape from the surface. In this case the constant pull from gravity slowly peels the tape from the surface, causing the tape to fail and decoration to fall. This effect can also occur when the tape is going over the top of a wide decoration.

Nails, tacks, and staples hold well however, when such fasteners are used they penetrate the decorated surface and therefore cause damage. Typically, they are designed for use as permanent fasteners.

In recent years, products such as 3M®'s Command™ line of fasteners including their Decorating Clips™ have been on the market. This fastener consists of a molded, rigid plastic base with a small hook and a pressure sensitive foam adhesive. The user places the foam adhesive on the base and applies the fastener to the surface being decorated. This fastener holds strong relative to its approximate one-half inch square base. It is designed so that the adhesive, foam extends over the base on one side to provide a tab for the user to pull on for removal. This causes the foam to stretch laterally relative to the decorated surface so that the adhesive bond is broken without damage to the decorated surface. However, these semi-permanent fasteners are expensive.

In a typical application, hundreds of fasteners may be needed at considerable cost. Also, they require the user to combine the base and adhesive foam for every fastener used, which in a typical application can take up considerable time. Another drawback is that the base is rigid and therefore cannot be used on some applications or on tight contoured surfaces. Also, the hook is very small, limiting the types and quantity of decorations fastened at each point. Additionally, although the molded base and hook are made of clear plastic, the foam adhesive which is applied to the base and the extended tab are white and therefore are noticeable when applied to darker surfaces.

It is also known to affix a twist-tie to an object such as a ribbon bow with a staple. In U.S. Pat. No. 4,915,996, to Curry, the twist-tie is formed of a base layer covered with an adhesive with a wire disposed between the adhesive-bearing base layer and a peelable cover. The twist-tie has the peelable cover removed, and uses the adhesive on the base layer to secure the ribbon bow to a surface, without twisting. The twist-tie is not twisted about itself (the twist-tie lies flat on the surface). Such a configuration will work only if the ribbon bow is located on top of the surface, for example on the top of a package. Such a configuration will not effectively secure the ribbon bow in a hanging position, since the surface area of the adhesive layer on the twist-tie is too small to effectively do so.

The current choices of fasteners available for attaching lightweight decorations to a variety of surfaces do not adequately meet consumer needs. Such fasteners are either too expensive or time consuming when applying to be practical in many cases, or are the surface penetrating type which leave holes, or in the case of tapes, are applied over the decoration, detracting from the overall appearance of the decoration and typically having a high failure rate.

SUMMARY

There is provided a fastener comprised of a twistable tie and a flexible adhesive base. The flexible base of an exemplary embodiment of a fastener can be adhesively attached to a variety of surface shapes or even over a corner when a release liner is first removed. The twistable ties each projecting outwardly in opposing directions from near or proximate the center of the base are used to clasp around the decoration when the decoration is first applied to the seat or center of the base and the ties are twisted together over the top of the decoration to secure it.

There is further provided a fastener which includes a base having a top portion and a bottom portion. The bottom portion includes an adhesive layer portion. An elongated pliable core member is coupled to the base, with the core member having a first end and a second end, with the first end extending beyond an edge of the base. A top portion and a bottom portion of the fastener may further include separate member sheets configured to align contiguously with each other and securely coupled together. In another embodiment the base is configured to define a plurality of notches, with each notch configured to define an apex proximate the center of the base and extending with divergent edges toward an edge of the base and with two notches on each side of elongated pliable core member. The plurality of notches defines two sections of the base, with one section configured independently of the other section and with one section being located on each side of the elongated pliable core member.

There is further provided a fastener including a base having a top portion and a bottom portion, with the bottom portion including an adhesive layer portion. An elongated pliable core member is integral with the base as a single unit, with the core member having a first end and a second end, with the first end extending beyond the edge of the base. The base is further configured to define a plurality of notches, with each notch configured to define an apex proximate the center of the base and extending with divergent edges toward an edge of the base and with two notches on each side of the elongated pliable core member. A plurality of notches defines two sections of the base, with one section configured independently of the other section and with one section on each side of the elongated pliable core member.

There is additionally provided a method for securing an object to a surface. The method includes providing a fastener comprising a base including a top portion and a bottom portion, with the bottom portion including an adhesive layer portion covered with a release liner. The fastener also includes an elongated pliable core member coupled to the base, with the core member having a first end and a second end, with at least the first end extending beyond an edge of the base. The method includes exposing the adhesive by removing the release liner and placing the bottom portion of the base against the surface with the adhesive contacting the surface. The object is placed against the top portion of the base and secured the object against the base with the pliable core member by twisting the first end and second end of the core member about themselves, wherein the object is secured between the two ends of the core member.

There is also provided a method of making a fastener. The fastener includes a base composed of a top sheet of material and a bottom sheet of material, with the bottom sheet including an adhesive layer. The fastener further includes an elongated pliable member coupled to the top sheet of material with at least one end of the elongated pliable member extending beyond the edge of the base. The method comprises the steps of providing a roll of top sheet material, providing a roll of bottom sheet material aligned a spaced distance from the roll of top sheet material, and providing a spool of wire aligned to extend between the rolls of top and bottom sheet material. The rolls of sheet material are simultaneously unrolled together while unspooling the wire. The top and bottom sheet materials are laminated to each other and encase the wire between the top and bottom sheet materials defining a twist-tie. An adhesive layer is applied to the bottom sheet material. A die in a die cutting process die cuts the laminated sheet material and wire into predetermined fastener shapes. The fastener shapes are separated into individual fasteners. The method may also include applying a release liner to the adhesive layer.

There is additionally provided a method of making a fastener, with the fastener including a base composed of a top portion and a bottom portion. The bottom portion includes an adhesive layer. The fastener further includes an elongated pliable member coupled to the base, with at least one end of the elongated pliable member extending beyond an edge of the base. The method comprises the steps of providing a roll of flexible sheet material and unrolling the roll of flexible sheet material. An adhesive layer is applied to the bottom portion of the flexible sheet material. The laminated sheet material and adhesive is die cut into predetermined fastener shapes. The method further includes providing a supply of twist-ties and coupling a twist-tie to each fastener shape. The method may also include separating the fastener shapes into individual fasteners. The method may further include applying a release liner to the adhesive layer. The method may provide the step of coupling a twist-tie to the base by an attachment process of one of an adhesive, a stitch, and a weld. The twist-tie may be coupled to the top portion of the base or to the bottom portion of the base.

DRAWINGS

Figure 11:
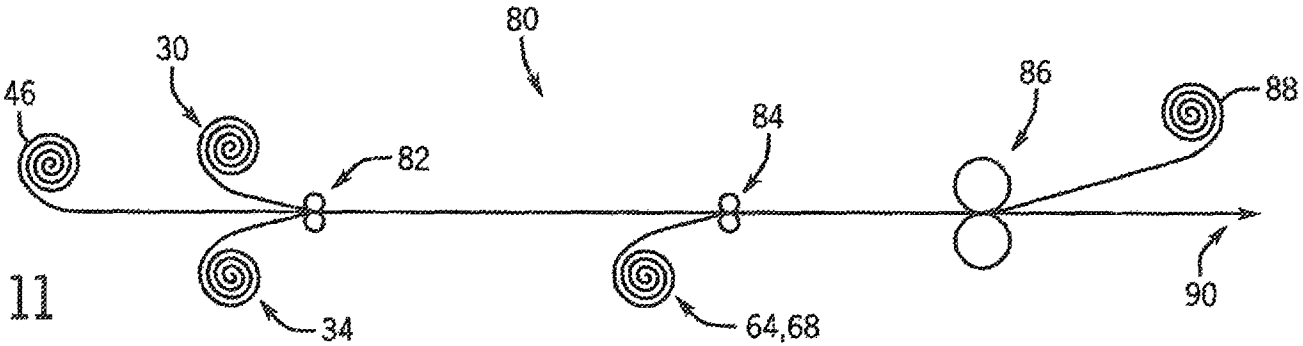
FIG. 11 is a schematic illustration of an exemplary embodiment of a manufacturing process for making a fastener including a base having an adhesive and an elongated pliable member coupled to the base, with the elongated pliable member composed of a wire encased between a top flexible sheet of material and a bottom flexible sheet of material defining the base.
Figure 12:
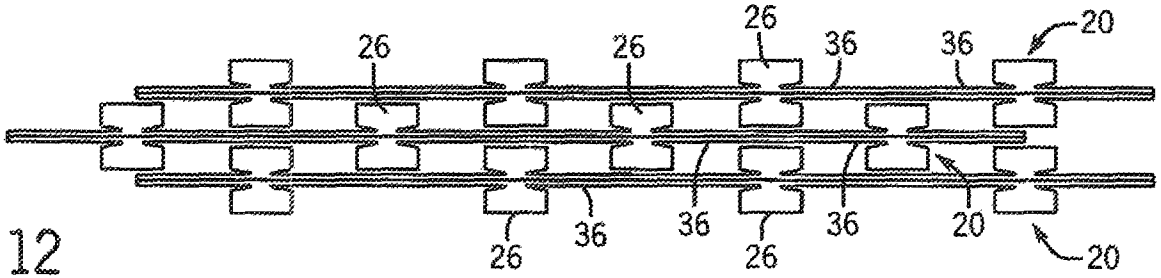
Figure 13:
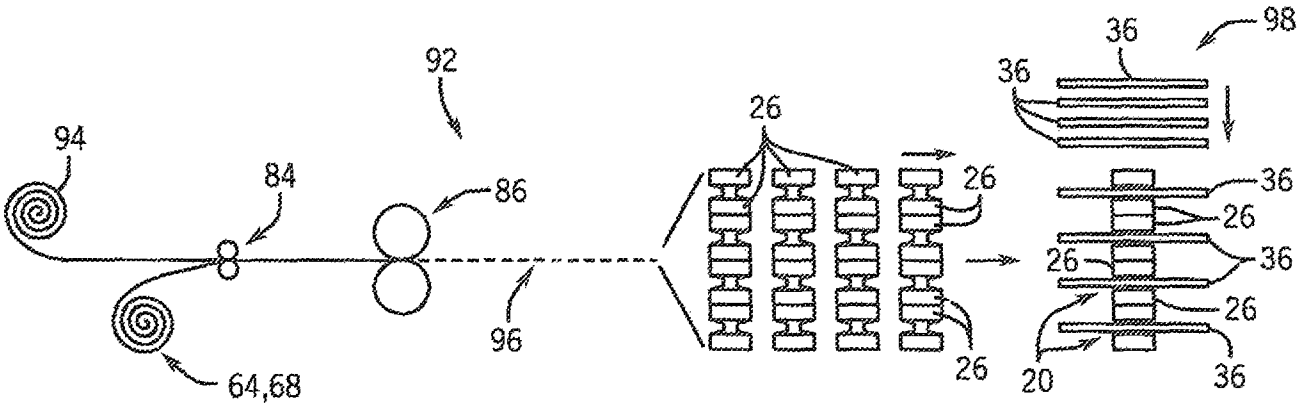

FIG. 12 is an illustration of a plurality of fastener shapes after die-cutting by the manufacturing process illustrated in FIG. 11; and FIG. 13 is a schematic illustration of an exemplary embodiment of a manufacturing process for making a fastener including a base having an adhesive and an elongated pliable member coupled to the base, with the elongated pliable member attached to the base by an attachment process of one of an adhesive, a stitch, and a weld to either a top portion or bottom portion of the base.

DETAILED DESCRIPTION

Before describing exemplary embodiments of a fastener 20 having an adhesive layer 64 base and a twist-tie type elongated pliable member 36, a number of advantages of the fastener 20 with adhesive base become evident. One such advantage is it is inexpensive due to ease of manufacture. The base, twist-tie, adhesive, and release liner are die-cut out of the same continuous lamination of flexible sheet materials such as paper or polyethylene and wire. The flexible base conforms and adheres to a variety of surface texture and shapes. The adhesive does not come into contact with the decoration. The twist-tie is also very handy in its application. The fastener is easily handled during its application and is versatile in that it can be configured to conform to a variety of different size objects 22 and secures the objects 22 with a simple twist of the tie ends 38, 40. Such advantages of the fastener 20 are more fully discussed below.

The fastener 20 can be manufactured at a high rate of speed from wide webs of flexible sheet materials laminated together with a wire core encased within the lamination and die-cut into individual fasteners that each consist of a base and a twist-tie sharing the same lamination that also allow it to lay flat for packaging and be relatively inexpensive, both of which are important considerations for a temporary fastener.

The fastener 20 can be constructed with the twist-ties emanating from the center of the base so that the weight being held is concentrated to the center of the adhesive base fastener, whereby the weight forces are distributed across the entire base causing a shear force across the base rather than a peel force. This further allows the base to hold strong yet be relatively small. The lamination that encases the flexible core of the twist-tie also provides a large surface area that is conjoined or contacted with the base, minimizing tear out. The apex 56 of the notches 52, more fully described below, and composition of the lamination, also minimize tearout.

The flexible base is conformable to a variety of surface shapes and even over corners in a straddling fashion, allowing the consumer to attach decorations to surfaces not currently possible with other fastening devices, including ceilings, walls, trim, glass, furniture, as well as many other surfaces limited only by one's imagination.

The lamination for the base and the twist-tie can consist of different materials such as paper or polyethylene so that the paper can provide a printable surface or provide decorative color options. Alternately, the lamination can be made up of a clear polyethylene or of similar material to make the fastener nearly invisible in use.

The twist-ties allow the fastener 20 to hold varying sized objects because they are conformable and have the capacity to go around a single object or multiple objects. The twist-ties have a protective lamination, making them easy to find and handle even with one hand when removing or undoing. The protective lamination also provides safe handling for the user, and protects the decoration from damage. Also, color choices including clear can be offered. The twist-ties allow quick adjustments to be made to decorations that are not placed correctly by simply untwisting the ties, making the adjustments, and re-twisting the ties.

The adhesive is on the bottom side of the base only and does not come into contact with the decorating materials, so as not to damage them so that they can be used again and again.

Fasteners can be first applied in a series without any decorations being attached until all of the fasteners have been applied. The decoration can then be attached to each fastener and secured by twisting each tie. This is especially helpful when having to work near ceiling heights and holding on to the decoration with one hand and twisting the ties with the other.

Figure 1:
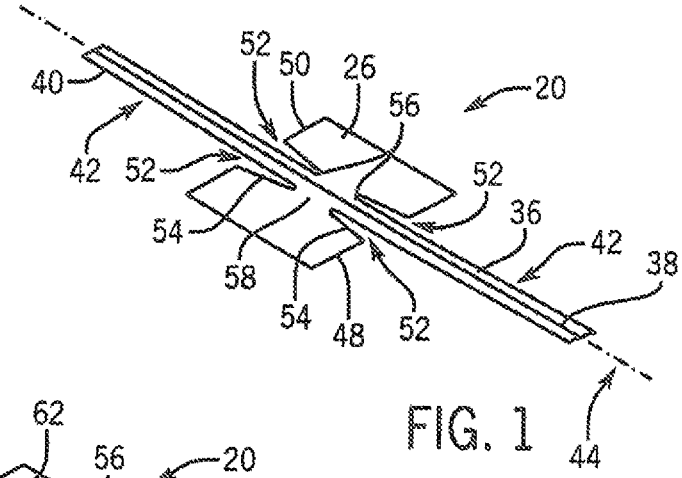
FIG. 1 is a perspective top view of an exemplary embodiment of a fastener including a base and an elongated pliable core member coupled to the base.
Figure 2:
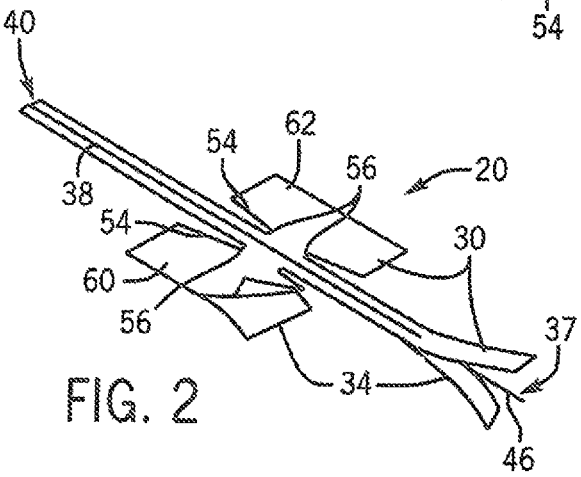
FIG. 2 is an isometric top view of the fastener illustrated in FIG. 1 showing a flexible wire core encased within a lamination of the top and bottom sheets of flexible materials.

Referring now to the figures, FIGS. 1 and 2 show an overall top view of a fastener 20 with an adhesive base 26 and a twist-tie type elongated pliable member 36. One embodiment of a fastener 20 includes a flexible base 26 composed of a lamination of a flexible top sheet material 30 and a flexible bottom sheet material 34 as shown in FIG. 2.

In an exemplary embodiment the overall size of the fastener 20 is approximately one inch square for the base with a twist-tie 36 length of about four inches from one end 38 to the other end 40. However, the fastener 20 is not limited to this size or proportion, and can be made larger or smaller depending upon application or consumer need. The two components, the base 26 and the twist-tie 36 of this embodiment, share the same lamination, namely a top sheet 30 and a bottom sheet 34, with a pliable core 37 such as wire 46 shown in FIG. 2. The four notches, indentations or cutouts 52 shown in FIG. 1, are cut into the base 26 to a depth of approximately one-third of the base width to create an apex 56 which can function as a pivot or hinge points for the elongated pliable member, also referred to as a twist-tie 36. The notches 52 also divide the base 26 into two sections to create a split base members 60 and 62 as shown in FIG. 2. In a preferred embodiment, the apex 56 defines a radius to minimize tear out by the twist-tie 36. The area shown in FIG. 1 between the notches 52 at the center of the base 26 is a seat or center of the base 58.

Many types of flexible sheet material are available, such as paper or polyethylene, and can be used in the lamination singularly such as paper bonded to paper or in combination such as paper bonded to polyethylene. The lamination process can begin with the flexible sheet material in wide web rolls, one for the top sheet of the lamination and another for the bottom sheet of the lamination. A pliable core such as the core member 37, for example a wire 46 in FIGS. 1 and 2, is encased within the lamination when the top portion 28 and bottom portion 32 sheets 30, 34 are laminated together with a suitable adhesive and pressure to securely couple the two sheets together. The lamination is die-cut, to cut out the base 14 and the elongated pliable member 36, referred to as a twist-tie having ends 38 and 40 as shown in FIG. 1.

Figure 3:
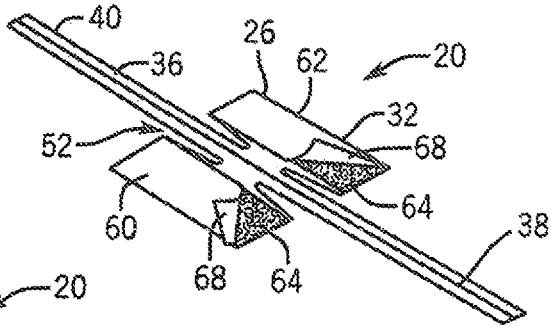
FIG. 3 is an isometric bottom view of the fastener illustrated in FIG. 1 showing a release liner partially removed from the base and exposing an adhesive layer.

FIG. 3 shows the bottom view of the fastener 20 illustrated in FIGS. 1 and 2. The base 26 has a pressure sensitive adhesive 64 (which may be a coating or a foam material) on each section 60, 62 of the base 26 adjacent to the elongated pliable member 36 and notches 52 as shown. Release liners 68, shown as being partially removed, protect the adhesive coated portions 64 of base 26 until ready for use. It should be understood that in one embodiment the adhesive layer 64 should cover most if not all of the bottom portion 32 of the base 26. In another embodiment, the adhesive layer 64 may not cover the entire bottom portion 32, for example not the center of the bottom portion 32 or one edge of the base 26, as determined by the manufacturer. However, it is contemplated that the adhesive layer 64 should cover most of the bottom portion 32, for example at least 90% of the bottom portion 32. The adhesive can be any suitable substance of sufficient strength for the intended purpose.

Figure 4:
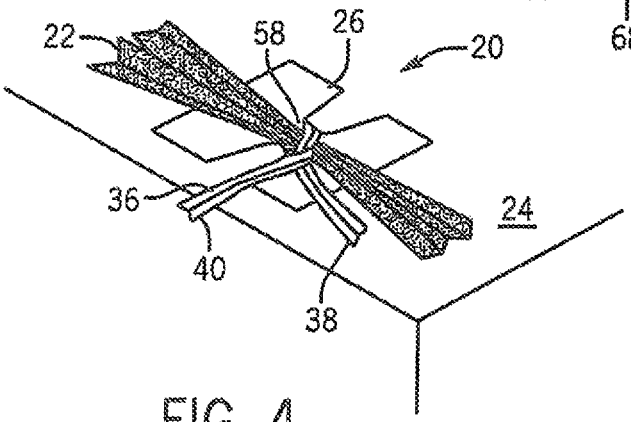
FIG. 4 is an isometric view of the fastener illustrated in FIG. 1 showing an object secured to the fastener by the ends of the elongated pliable core member twisted together.

FIG. 4 shows an isometric top view of the fastener 20 that can be affixed to a variety of surfaces of different shapes, textures, and planes. With the embodiment shown in FIG. 4, the fastener 20 is adhered to the underside of a horizontal surface 24 such as, for example, a ceiling. The object 22 is attached to the surface 24 when the object 22 is first placed at the center (seat) 58 of the base 26 and the ends 38, 40 of the twist-tie 36 are hinged at the apex 56 of the notches 52, vertically from the base 26 and over the object 22 and twisted together.

A method of making a fastener 20 is illustrated in FIGS. 11 and 12. The fastener 20 includes a base 26 which consists of a top sheet of material 30 and a bottom sheet of material 34. The bottom sheet 34 includes an adhesive layer 64. The fastener 20 further includes an elongated pliable member 36 which may be referred to as a twist-tie coupled to the top sheet of material 30 with at least one end 38 of the elongated pliable member 36 extending beyond an edge 48 of the base 26.

The manufacturing process 80 illustrated in FIGS. 11 and 12 provides a roll of top sheet material 30 is provided together with a roll of bottom sheet material 34. The roll of top sheet material 30 and the roll of bottom sheet material 34 are aligned a spaced distance from each other and are configured to unroll simultaneously. A spool of wire is aligned with the two spools of sheet material 30, 34 and is configured to extend between the top and bottom sheet material rolls 30, 34 as the wire 46 is unspooled. The top and bottom sheet materials 30, 34 are laminated together, using a combination of suitable adhesive and pressure, with the wire 46 located between the top and bottom sheet materials 30, 34, thereby encasing the wire 46 between the top and bottom sheet materials 30, 34 to define the elongated pliable member defining the elongated pliable member 36 or twist-tie 36. The top and bottom sheet material 30, 34 and the wire 46 are laminated at a lamination station 82 which is configured to apply an adhesive between the top 30 and bottom 34 sheet materials and apply a suitable pressure to the sheet materials 30, 34 and wire 46 to form a laminated structure.

The laminated structure of the top and bottom sheet materials 30, 34 encasing the wire 46 is moved to an adhesive station 84, where an adhesive layer 64 is applied to the bottom sheet material 34. After the adhesive layer 64 and release liner 68 is applied to the laminated structure, a die at a die-cutting station 86 cuts the laminated sheet material and wire into a predetermined fastener shape as illustrated in FIG. 12. Following the die cutting operation, waste material 88 is collected and the fastener shapes are moved to a separation/packaging station 90 where the individual fasteners 20 may be separated and packaged.

The method of making the fastener 20 may also include the application of a release liner 68 to the adhesive layer 64. Such application of the release liner 68 can either be done in a separate station or it can be done simultaneously as illustrated in FIG. 11 with the application of the adhesive layer 64. As previously discussed, the bottom and top sheet materials 30, 34 can be paper or a polyethylene plastic, or a metal foil, or various appropriate combinations of such materials. It should be understood that the top and bottom sheet materials 30, 34 should be flexible and resilient in accord with its intended use.

A method of manufacturing 92 a fastener 20 is also provided where the base 26 is formed and the elongated pliable member 36 or twist-tie is coupled to the base in a separate operation, as illustrated in FIG. 13. Such a method of making the fastener 20 includes providing a roll of flexible sheet material 94, unrolling the flexible sheet material 94, and applying an adhesive layer 64 at an adhesive station 84 to the bottom portion 32 of the flexible sheet material 94. A die cutting operation at a die-cutting station 86 cuts the flexible sheet material 94 and adhesive into predetermined fastener shapes as illustrated in FIG. 13.

A supply 98 of twist-ties 36 are provided along the manufacturing line, and a twist tie 36 is coupled to each fastener shape (see FIG. 13). In the illustrated manufacturing process, the bases 26 are die cut in groups of four (4) where the bases 26 must be separated from each other. FIG. 13 depicts the die-cut fastener bases 26 rotated 90 degrees at point 96 to clearly illustrate how the bases 26 may be die cut. This illustration and configuration demonstrates an exemplary embodiment of the process 92.

It should be understood that other die-cut configurations can be used within the scope of the appended claims. The manufacturing process may also provide that the twist-ties 36 are applied to each individual base 26 when the bases 26 are coupled together, or when they are separated. The manufacturing process also includes applying a release liner 68 to the adhesive layer 64, which may be done simultaneously as illustrated in FIG. 13 during the process or at a separate station.

The method of making a fastener also includes coupling the twist-tie 36 to the base 26 by an attachment process such as using an adhesive, a stitch 70, or a weld. If an adhesive is used, it should be an adhesive that is compatible with the types of flexible sheet material and twist-tie material being used, and one that has sufficient strength for its intended use. If a stitch is used (see FIGS. 5 and 7), the thread used should be compatible with the type of material used in the base 26 and elongated pliable member 36, with an example of the material of the thread being polyethylene or another suitable material. If the weld attachment process is used (see FIG. 6), the welding process should be of a type that will not damage the flexible sheet material or the elongated pliable member material. One such welding process is, for example, ultrasonic welding.

It should also be understood that the manufacturing process in any of the processes described above may include a station where printed material is applied to the base 26. Such printed material may include directions and/or warnings. It should also be understood that various color coatings may be applied to the fastener as selected by the manufacturer or the user.

The method of securing an object 22 to a surface 24 with the fastener 20 having a twist-tie 36 with adhesive can be easiest understood when describing its use in attaching lightweight decorations, for example a garland, to a variety of surfaces, for example ceilings, window and door trim, glass, paneling, painted or papered drywall, etc. The fastener 20 is especially suited for linear type decorations utilizing the twist-ties 36 to secure the decoration.

The user would begin by removing the release liner 68 from the bottom portion 32 of the base 26 of the fastener 20 as shown in FIG. 3. With the adhesive layer 64 of the base 26 now exposed, the fastener 20 can be placed and adhered to any desired surface 24. Because the base 26 is made of flexible sheet materials such as paper, it can conform to a variety of shapes, including over or around a corner. The base 26 and the twist-tie 36 are constructed out of the same lamination, and are therefore located on the same plane, as shown in FIG. 2.

FIG. 2 also shows a flexible or pliable core 37, for example a wire 46, that runs through the center along the longitudinal axis 44 of the elongated pliable member 36 that becomes the flexible core of the twist-tie 36. The flexible lamination of the sheets 30, 34 encase the flexible core 37 and provide for easy-to-handle twistable tie ends 38 and 40. The lamination of flexible sheet material 30, 34 also allows the twist-tie 36 to be easily seen and untwisted during removal of the object 22. It also provides color and printing options, as well as providing a protective covering so as not to damage the object 21, or cause injury to the user. It should be understood that the base 26 can be made of a transparent material to allow a user to precisely place the fastener 26 at a specific location on a surface 24. The fastener 20 may also support text, such as for example, instructions, warnings, and the like.

The four notches 52 defined in the base 26 serve two purposes. First, the apex 56 of each notch 52 provides hinge points for the elongated pliable member 36 to be set deep within the perimeter of or proximate the center 58 of the base 26, as shown in FIG. 1. This causes the forces of the weight being supported to be directed from the center 58 of the base 26, as shown in FIG. 4, outwardly to the perimeter of the base 26, resulting in a shear force across the entire base 26 and allowing the base 26 to hold more weight relative to its size then if it were subjected to a peel force of the type that causes adhesive tape to fail.

The notches 52 further configure the base 26 into two sections 60 and 62, as shown in FIGS. 2 and 3, which act independently of each other, thus providing even greater flexibility and conformability to surface variations and shapes. The ends 38 and 40 of the elongated pliable member 36 remain in an open or spread out position as they are shown in FIG. 1. The user at this point may hold the object 22, such as a decoration, over the seat 58 of the base 26 FIGS. 1 and 4, with one hand flexing the ends 38, 40 of the twist-ties 36 up from hinge points 56 and over the decoration 22, and then twisting the ends 38, 40 together to secure the object 22 as shown in FIG. 4.

Figure 5:
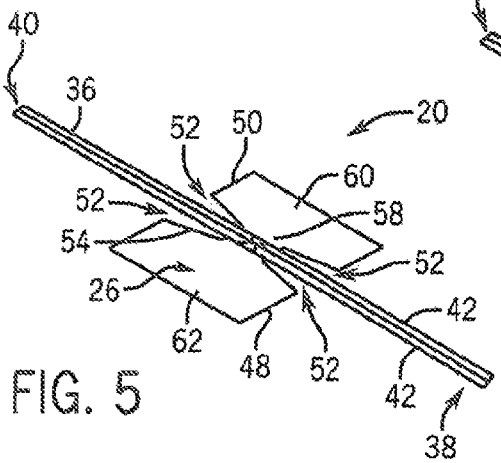
FIG. 5 is an isometric top view of another exemplary embodiment of a fastener including a twist-tie type elongated pliable core member coupled to a top portion of the base of the fastener.
Figure 6:
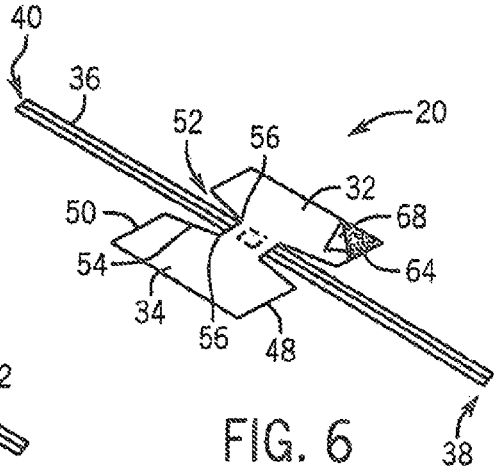
FIG. 6 is an isometric bottom view of the fastener illustrated in FIG. 5 with a release liner partially removed from an adhesive layer.
Figure 7:
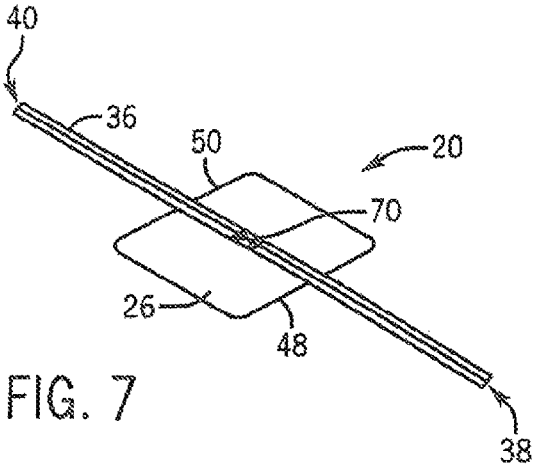
FIG. 7 is an isometric top view of another exemplary embodiment of a fastener including a twist-tie type elongated pliable member coupled to a top portion of a base, the base configured without notches.

Additional exemplary embodiments are illustrated in FIGS. 5, 6, 7, 8, 9, and 10. FIG. 5 shows an isometric top view of the fastener 20 with the twist-tie 36 attached by an adhesive, with a stitch 70, or by an ultrasonic weld to the center of the base 26. FIG. 6. shows the bottom view of the embodiment shown in FIG. 5, with the release liner 68 partially removed from the base 26. FIG. 7 is another embodiment with the twist-tie 26 attached as is shown in FIG. 5, with the base 26 not having notches located therein.

Figure 8:
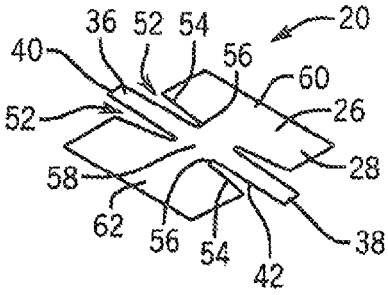
FIG. 8 is an isometric top view of another exemplary embodiment of a fastener configured with a base and elongated pliable core member, configured as a single unit of a metallic foil.
Figure 9:
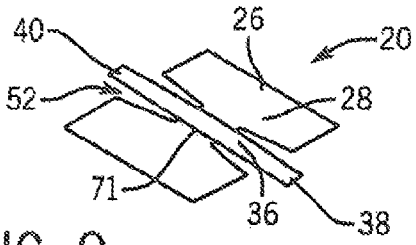
FIG. 9 is an isometric top view of another exemplary embodiment of the fastener illustrated in FIG. 8 including an additional strip of foil laminated contiguously with the elongated pliable core member to strengthen the elongated member portion of the fastener.
Figure 10:
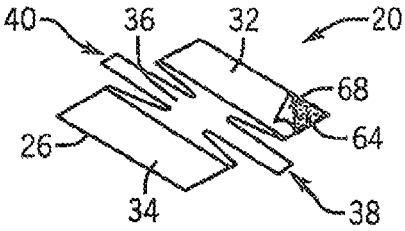
FIG. 10 is an isometric bottom view of the fastener illustrated in each of FIGS. 8 and 9.

FIG. 8 shows a perspective view of another embodiment that has both the base 26 and the twist-tie 36 composed of a single sheet of heavy metallic foil in a unitary construction. The metallic foil provides flexibility for the base 26 and has a similar conformable quality as the wire twist-tie 36 shown in FIG. 4 when the ends 38 and 40 of the elongated pliable member 36 of FIG. 8 are twisted together. FIG. 9 is another embodiment of the fastener 26 shown in FIG. 8 which includes an additional foil lamination strip 71 bonded to the base 26 and the elongated pliable member 36 to provide additional tear resistance and strength to the ends 38, 40. FIG. 10 shows the bottom view of the fasteners 26 shown in FIGS. 8 and 9 with the bottom portion 32 of the base 26 having the release liner 68 partially removed from the adhesive layer 64 of the base 26.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Accordingly, the fastener provides a simple, inexpensive, and more versatile alternative to currently available methods for temporarily securing lightweight decorations to a surface. The fasteners lay flat for packaging, yet when used the twist-ties hinge vertically upwardly from the base and provide for an adjustable carrying capacity. The fasteners hold strong relative to their size, yet remove cleanly and safely without damaging the decorations or the surfaces being decorated. The fasteners allow for quick adjustments of the decorations by simply untwisting the twist-ties, making the adjustments and re-twisting the ties. The fasteners provide the consumer with greater flexibility in where they decorate and how they decorate, allowing them much more freedom with regard to creativity and design choices then was previously possible. It should be understood that by changing the size, strength of materials, and adhesive used the fastener can be made for permanent use.

Although the foregoing description of a fastener has been shown and described with reference to particular embodiments and applications thereof, it has been presented for purposes of illustration and description and is not intended to be exhaustive or to limit the disclosure to the particular embodiments and applications disclosed, it will be apparent to those having ordinary skill in the art that a number of changes, modifications, variations, or alterations to the fastener as described herein may be made, none of which depart from the spirit or scope of the present disclosure. The particular embodiments and applications were chosen and described to provide the best illustration of the principles of the fastener and its practical application to thereby enable one of ordinary skill in the art to utilize the fastener in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed:

1. A fastener assembly comprising:

a base having a pair of opposed base members and a pair of elongate portions joined to one another, the pair of elongate portions connected between the pair of base members to a center of the base and separated from the pair of base members between the center of the base and opposed edges of the base members, the base including a top portion and a bottom, portion, with the bottom portion including an adhesive layer portion disposed only on portions of the base adapted to be directly engaged with a surface;

an elongated pliable core member coupled to the center of the base in alignment with the pair of elongate portions, the core member having opposed first and a second ends extending beyond opposed edges of the base members, wherein the first and second ends of the core member and the pairs of elongate portions are foldable with respect to the pair of base members to be releasably engaged with one another to hold an object on the fastener opposite the adhesive portion.

2. The fastener of claim 1, wherein the base is flexible.

3. The fastener of claim 2, wherein the top portion and bottom portion further comprising separate member sheets, configured to align contiguously with each other and securely couple together.

4. The fastener of claim 3, wherein the core member is disposed between the top portion member sheet and the bottom portion member sheet and encased by the top and bottom portion member sheets.

5. The fastener of claim 1, wherein the pliable core member is a wire.

6. The fastener of claim 1, including a release liner configure to removably cover the adhesive.

7. The fastener of claim 1, wherein the base is planar.

8. The fastener of claim 7, wherein the longitudinal axis oaf the pliable core member extends through the center of the planar base.

9. The fastener of claim 1, wherein the pliable core member is coupled, to the base with one of an adhesive, a stitch, and a weld.

10. The fastener of claim 1, wherein the pliable core member is coupled to the top portion of the base.

11. A method for securing an object to a surface, the method comprising:

a) providing the fastener of claim 1;

b) placing the bottom portion of the base against the surface with the adhesive contacting the surface;

c) placing the object against the top portion of the base; and d) securing the object against the base by engaging the first and second ends of the pliable core member to one another around the object.

12. The method of claim 11, wherein the base is planar.

13. The method of claim 12, wherein the longitudinal axis of the pliable core member extends through the center of the planar base.

14. The method of claim 11, wherein the base is flexible.

* * * * *